US010428434B2

(12) United States Patent
Tarutani et al.

(10) Patent No.: US 10,428,434 B2
(45) Date of Patent: Oct. 1, 2019

(54) ADDITIVE FOR HIGH-PURITY COPPER ELECTROLYTIC REFINING, METHOD OF PRODUCING HIGH-PURITY COPPER, AND HIGH-PURITY ELECTROLYTIC COPPER

(71) Applicant: MITSUBISHI MATERIALS CORPORATION, Tokyo (JP)

(72) Inventors: Yoshie Tarutani, Naka (JP); Kenji Kubota, Naka (JP); Kiyotaka Nakaya, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 239 days.

(21) Appl. No.: 15/277,508

(22) Filed: Sep. 27, 2016

(65) Prior Publication Data

US 2017/0088963 A1 Mar. 30, 2017

(30) Foreign Application Priority Data

Sep. 30, 2015 (JP) ..... 2015-194834
May 30, 2016 (JP) ..... 2016-107269
Aug. 20, 2016 (JP) ..... 2016-161591

(51) Int. Cl.
*C25C 1/12* (2006.01)

(52) U.S. Cl.
CPC ..... *C25C 1/12* (2013.01)

(58) Field of Classification Search
CPC ..... C25C 1/12
See application file for complete search history.

(56) References Cited

U.S. PATENT DOCUMENTS 2,171,842 A * 9/1939 Barrett ..... C25D 3/02 205/306
2,769,775 A * 11/1956 Schloen ..... C25C 1/12 205/296
6,391,188 B1 * 5/2002 Goosey ..... C22B 3/22 204/240
6,610,192 B1 * 8/2003 Step ..... C25D 3/38 205/297
2004/0249177 A1 * 12/2004 Wang ..... C25D 3/38 549/563
2005/0061202 A1 * 3/2005 Hosomi ..... C23C 22/52 106/31.65
2005/0077250 A1 * 4/2005 Goosey ..... C02F 9/00 210/748.15
2007/0007143 A1 * 1/2007 Hayashi ..... C25D 3/38 205/125
2007/0170067 A1 * 7/2007 Kubota ..... C25D 3/56 205/244
2008/0149494 A1 * 6/2008 Tsuchiya ..... C25C 1/12 205/575
2010/0028198 A1 * 2/2010 Fabian ..... C22B 3/0097 420/469
2013/0334057 A1 * 12/2013 Watanabe ..... C25C 1/12 205/296

FOREIGN PATENT DOCUMENTS

JP 08-000990 B 1/1996
JP 2001-123289 A 5/2001
JP 2005-307343 A 11/2005

OTHER PUBLICATIONS

Saxena, S.K., Polyvinyl Alcohol (PVA) Chemical and Technical Assessment (CTA), 61st JECFA (Joint FAO/WHO Expert Committee on Food Additives), 2004 (no month), pp. 1-3 (Year: 2004).*

* cited by examiner

*Primary Examiner* — Harry D Wilkins, III
(74) *Attorney, Agent, or Firm* — Locke Lord LLP

(57) ABSTRACT

The present invention provides an additive for high-purity copper electrolytic refining, a method of producing high-purity copper, and a high-purity electrolytic copper. This additive of the present invention for high-purity copper electrolytic refining can be added to a copper electrolyte in copper electrolytic refining. The additive includes a silver and chlorine reducing agent of electrolytic copper which is formed of tetrazoles which is one of a tetrazole and a tetrazole derivative.

13 Claims, No Drawings

ADDITIVE FOR HIGH-PURITY COPPER ELECTROLYTIC REFINING, METHOD OF PRODUCING HIGH-PURITY COPPER, AND HIGH-PURITY ELECTROLYTIC COPPER

BACKGROUND OF THE INVENTION

Field of the Invention

The present invention relates to an additive for high-purity copper electrolytic refining which is used to produce high-purity copper in which concentrations of chlorine and silver are small, a method of producing high-purity copper, and a high-purity electrolytic copper.

Priority is claimed on Japanese Patent Application No. 2015-194834, filed on Sep. 30, 2015, Japanese Patent Application No. 2016-107269, filed on May 30, 2016, and Japanese Patent Application No. 2016-161591, filed on Aug. 20, 2016, the contents of which are incorporated herein by reference.

Background Art

As described in Japanese Examined Patent Application, Second Publication No. H08-990, a method of performing electrolysis on two stages of performing electrolysis in a copper sulfate aqueous solution, then performing electrolysis again in a copper nitrate aqueous solution at a low current density of 100 $A/m^2$ or less by means of using copper deposited on a cathode as an anode, is known as a method of producing high-purity copper.

Further, as described in Japanese Unexamined Patent Application, First Publication No. 2001-123289, a method of producing electrolytic copper foil in which mechanical characteristics and adhesion to a cathode are improved by adding a polyoxyethylene-based surfactant such as polyethylene glycol (PEG) to a copper sulfate electrolyte that contains chloride ion, glue, and an active sulfur component is known. Further, as described in Japanese Unexamined Patent Application, First Publication No. 2005-307343, a method of producing high-purity electrolytic copper of which the surface is smooth and in which the content of impurities such as silver and sulfur is small by addition of a smoothing agent such as polyvinyl alcohol (PVA) and a slime accelerator such as PEG, is known.

SUMMARY OF THE INVENTION

Technical Problem

The conventional copper electrolytic refining in which chloride ions are added to a copper electrolyte have effects of improving a form of electrolytic copper deposited on a cathode substrate and settling the silver ions in the copper electrolyte as silver chloride particles to remove the silver ions from the copper electrolyte and thereby prevent silver from depositing with the copper on the cathode substrate. However, all of silver ions in the copper electrolyte cannot be precipitated only by chloride ions. Further, there is a problem in that the chloride ions added to the copper electrolyte transfer to the cathode substrate and thereby the purity of the electrolytic copper degrades. Therefore, it is difficult for the conventional copper electrolytic refining to decrease the silver and chlorine concentrations.

In the producing method including two stages of performing electrolysis in a copper sulfate bath and electrolysis in a copper nitrate bath as that of Japanese Examined Patent Application, Second Publication No. H08-990, there is a problem in that considerable time and efforts are taken in the electrolysis. Further, by using only PEG or PVA as described in Japanese Unexamined Patent Application, First Publication No. 2001-123289 and Japanese Unexamined Patent Application, First Publication No. 2005-307343, chloride and silver concentrations in the electrolytic copper deposited on the cathode substrate cannot be reduced sufficiently.

An object of the present invention is to provide an additive for high-purity copper electrolytic refining containing a silver and chlorine reducing agent for copper electrolytic refining which solves the above-described problems of the conventional method and facilitates producing a high-purity copper containing chlorine and silver at a small amount, and a method of producing high-purity copper using such an additive.

Solution to Problem

The present invention provides an additive for high-purity copper electrolytic refining which solves the above-described problems and has following configurations.

[1] An additive for high-purity copper electrolytic refining which is an additive to be added to a copper electrolyte in copper electrolytic refining, the additive including: a silver and chlorine reducing agent of electrolytic copper which is formed of tetrazoles which is one of a tetrazole and a tetrazole derivative.

[2] The additive for high-purity copper electrolytic refining according to [1], in which the tetrazole derivative is one of an alkyl derivative, an amino derivative, and a phenyl derivative of tetrazole.

[3] The additive for high-purity copper electrolytic refining according to [1] or [2], in which the additive further includes an impurity reducing agent formed of one of a polyethylene glycol and a non-ionic surfactant, the non-ionic surfactant having a hydrophobic group containing an aromatic ring and a hydrophilic group containing a polyoxyalkylene group.

[4] The additive for high-purity copper electrolytic refining according to any one of [1] to [3], in which the additive further includes a stress relaxation agent formed of a polyvinyl alcohol or a derivative thereof.

[5] The additive for high-purity copper electrolytic refining according to [4], in which the polyvinyl alcohol or the derivative thereof in the stress relaxation agent has a saponification rate of 70 to 99% by mole and an average polymerization degree of 200 to 2500.

The present invention also provides a method of producing high-purity copper and a high-purity electrolytic copper produced by the method which have following configurations.

[6] A method of producing high-purity copper, including: performing copper electrolytic refining using a copper electrolyte to which a silver and chlorine reducing agent formed of tetrazoles is added.

[7] The method of producing high-purity copper according to [6], in which the copper electrolytic refining is performed using the copper electrolyte to which a impurity reducing agent formed of one of a polyethylene glycol and a non-ionic surfactant is added together with the silver and chlorine reducing agent, the non-ionic surfactant having a hydrophobic group containing an aromatic ring and a hydrophilic group containing a polyoxyalkylene group.

[8] The method of producing high-purity copper according to [7], in which the impurity reducing agent is one of a polyethylene glycol, a polyoxyethylene monophenyl ether, and a polyoxyethylene naphthyl ether.

[9] The method of producing high-purity copper according to any one of [6] to [8], in which the copper electrolytic refining is performed using the copper electrolyte to which a stress relaxation agent is added together with the silver and chlorine reducing agent or combination of the silver and chlorine reducing agent and the impurity reducing agent, the stress relaxation agent being formed of a polyvinyl alcohol or a derivative thereof.

[10] The method of producing high-purity copper according to [9], in which the stress relaxation agent is one of a polyvinyl alcohol, a carboxy-modified polyvinyl alcohol, an ethylene-modified polyvinyl alcohol, and a polyoxyethylene-modified polyvinyl alcohol.

[11] The method of producing high-purity copper according to [9] or [10], in which the polyvinyl alcohol or the derivative thereof which has a saponification rate of 70 to 99% by mole and an average polymerization degree of 200 to 2500 is used as the stress relaxation agent.

[12] The method of producing high-purity copper according to any one of [6] to [11], in which a concentration of the silver and chlorine reducing agent in the copper electrolyte is set to be in a range of 0.1 to 30 mg/L.

[13] The method of producing high-purity copper according to any one of [7] to [12], in which a concentration of the impurity reducing agent in the copper electrolyte is set to be in a range of 2 to 500 mg/L.

[14] The method of producing high-purity copper according to any one of [9] to [13], in which a concentration of the stress relaxation agent in the copper electrolyte is set to be in a range of 0.1 to 100 mg/L.

[15] A high-purity electrolytic copper which is produced by the method according to any one of [6] to [14], in which a chlorine concentration is 50 ppm by mass or less and a silver concentration is 1 ppm by mass or less.

Advantageous Effects of Invention

By using the additive for high-purity copper electrolytic refining of the present invention in a copper electrolytic refining, it is possible to obtain a high-purity electrolytic copper with a low silver concentration and chlorine concentration. Specifically, it is possible to obtain a high-purity electrolytic copper having a chlorine concentration of 50 ppm by mass or less and a silver concentration of 1 ppm by mass or less.

In a copper electrolytic refining, an impurity reducing agent and/or a stress relaxation agent is used together with a silver and chlorine reducing agent as the method of producing high-purity copper of the present invention, and thereby it is possible to obtain a high-purity copper in which the silver concentration is further decreased and a sulfur concentration is low and which is not warped and does not peel from a cathode substrate, which is preferable.

DETAILED DESCRIPTION OF THE INVENTION

Detailed Description

Hereinafter, embodiments of the present invention will be described in detail.

The present embodiment relates to an additive for high-purity copper electrolytic refining which is a silver and chlorine reducing agent for electrolytic copper which is formed of one of a tetrazole and a tetrazole derivative (which are referred as "tetrazoles", hereafter) and is to be added to a copper electrolyte in copper electrolytic refining. In other words, the present embodiment relates to an additive for high-purity copper electrolytic refining which is an additive to be added to a copper electrolyte for copper electrolytic refining and includes a silver and chlorine reducing agent of electrolytic copper which is formed of one of a tetrazole and a tetrazole derivative. The present embodiment also relates to an additive for high-purity copper electrolytic refining including an impurity reducing agent and a stress relaxation agent together with the silver and chlorine reducing agent. Further, the present embodiment relates to a method of producing high-purity copper using these additives and a high-purity electrolytic copper produced by the method.

In the present embodiment, tetrazoles are used as the silver and chlorine reducing agent for high-purity copper electrolytic refining. The tetrazoles is a tetrazole or a tetrazole derivative. As the tetrazole derivative, for example, an alkyl derivative, an amino derivative, or a phenyl derivative of tetrazole can be used. Specifically, as the silver and chlorine reducing agent, 1H-tetrazole, 5-amino-1H-tetrazole, 5-methyl-1H-tetrazole, 5-phenyl-1H-tetrazole, or the like can be used.

In the present embodiment, the silver and chlorine reducing agent formed of the above-mentioned tetrazoles is used with addition to a copper electrolyte in copper electrolytic refining and reduce the chlorine and silver concentrations in electrolytic copper. The tetrazoles used as the silver and chlorine reducing agent forms a hardly soluble substance with silver ions contained in a copper electrolyte so as to reduce the silver ions in the copper electrolyte, whereby an amount of silver deposited on a cathode substrate is reduced. The tetrazoles also interact with chloride ions contained in a copper electrolyte thereby preventing chloride from depositing on the cathode substrate. On the other hand, copper ions contained in a copper electrolyte do not form a hardly soluble substance with the tetrazoles. Since the silver ions and chloride ions are selectively interacted with the tetrazoles, electrolytic copper with significantly low chlorine concentration and silver concentration can be obtained without an interference of electrocrystallization of copper ions caused by tetrazoles. Specifically, by using the silver and chlorine reducing agent of the present embodiment, the chlorine concentration and the silver concentration in electrolytic copper deposited on the cathode substrate can be reduced to, for example, approximately ¼ to ⅔, compared with a case without use of it.

In the conventional method where chloride ions are added to a copper electrolyte to react with the silver ions therein thereby precipitating silver chloride, it is difficult to precipitate all silver ions in a copper electrolyte as silver chloride only by means of chloride ions. Thus, silver is deposited on the cathode substrate, resulting in an increase of the silver concentration in electrolytic copper. Accordingly, it is not possible to obtain electrolytic copper with low silver concentration as the present embodiment.

The concentration of the silver and chlorine reducing agent added to a copper electrolyte (concentration in a copper electrolyte) is preferably 0.1 to 30 mg/L and more preferably 0.5 to 10 mg/L. When the concentration of the silver and chlorine reducing agent is less than 0.1 mg/L, sufficient effect cannot be obtained. When the concentration exceeds 30 mg/L, the electrocrystallization state on the cathode substrate deteriorates and thereby coarse dendrites generate (hereafter, dendritic deposit deposited on the cathode substrate is referred as "dendrite"). There is a case where dendrite with a length of 2 cm or more generates depending on electrolytic conditions.

In the present embodiment, an impurity reducing agent formed of a polyethylene glycol or a non-ionic surfactant which has a hydrophobic group containing an aromatic ring and a hydrophilic group containing a polyoxyalkylene group may be used together with the above-mentioned silver and chlorine reducing agent, and thereby sulfur concentration in electrolytic copper can be reduced and the silver concentration can be further reduced. Specifically, by adding the impurity reducing agent formed of a polyethylene glycol or a non-ionic surfactant which has a hydrophobic group containing an aromatic ring and a hydrophilic group containing a polyoxyalkylene group to a copper electrolyte, for example, the surface of electrolytic copper becomes smooth and silver ions and sulfate ions in the copper electrolyte becomes unlikely to remain on the surface of the electrolytic copper. As a result, the silver concentration and the sulfur concentration in the electrolytic copper can be greatly reduced.

The impurity reducing agent is formed of a polyethylene glycol, or a non-ionic surfactant which has a hydrophobic group containing an aromatic ring and a hydrophilic group containing a polyoxyalkylene group. In the non-ionic surfactant which has a hydrophobic group containing an aromatic ring and a hydrophilic group containing a polyoxyalkylene group, the hydrophobic group is a phenyl group, a naphthyl group, or the like, and examples thereof include monophenyl, naphthyl, cumyl, alkylphenyl, styrenated phenyl monophenyl, naphthyl, cumyl, alkylphenyl, styrenated phenyl, distyrenated phenyl, tristyrenated phenyl, and tribenzyl phenyl. The polyoxyalkylene group of the hydrophilic group is a polyoxyethylene group, a polyoxypropylene group, or the like and may include both of a polyoxyethylene group and a polyoxypropylene group. Further, an added number of moles of a polyoxyalkylene group of the hydrophilic group is preferably 2 to 20. When the added number of moles is less than 2, the impurity reducing agent is not dissolved in a copper electrolyte. When the added number of moles exceeds 20, the yield of electrolytic copper tends to be decreased. The added number of moles of a polyoxyethylene group of the hydrophilic group is more preferably 2 to 15, but the added number is not limited thereto.

Specific examples of the compound of the impurity reducing agent include polyethylene glycol, polyoxyethylene monophenyl ether, polyoxyethylene methyl phenyl ether, polyoxyethylene octyl phenyl ether, polyoxyethylene dodecyl phenyl ether, polyoxyethylene naphthyl ether, polyoxyethylene styrenated phenyl ether, polyoxyethylene distyrenated phenyl ether, polyoxyethylene tristyrenated phenyl ether, polyoxyethylene cumyl phenyl ether, polyoxypropylene monophenyl ether, polyoxypropylene methyl phenyl ether, polyoxypropylene octyl phenyl ether, polyoxypropylene dodecyl phenyl ether, polyoxypropylene naphthyl ether, polyoxypropylene styrenated phenyl ether, polyoxypropylene distyrenated phenyl ether, polyoxypropylene tristyrenated phenyl ether, and polyoxypropylene cumyl phenyl ether.

The concentration of the impurity reducing agent added to a copper electrolyte (concentration in a copper electrolyte) is preferably 2 to 500 mg/L and more preferably 10 to 300 mg/L. When the concentration of the impurity reducing agent is less than 2 mg/L or exceeds 500 mg/L, the effect of reducing the sulfur concentration in the electrolytic copper is insufficient.

In the present embodiment, a stress relaxation agent formed of a polyvinyl alcohol or a derivative thereof may be used together with the silver and chlorine reducing agent or combination of the silver and chlorine reducing agent and the impurity reducing agent, it is possible to obtain the electrolytic copper deposit on the cathode substrate which is not substantially warped and has further reduced sulfur concentration.

The stress relaxation agent relaxes the stress in electrodeposits of electrolytic copper deposited on the cathode substrate to prevent the electrolytic copper from falling off the cathode substrate. Since the electrolytic copper is stably held by the cathode substrate for a long period of time by relaxing the stress in electrodeposits, it is possible to obtain electrolytic copper which is finely deposited and has a smooth surface.

The polyvinyl alcohol derivative used as the stress relaxation agent is, for example, a carboxy-modified polyvinyl alcohol, an ethylene-modified polyvinyl alcohol, or a polyoxyethylene-modified polyvinyl alcohol.

It is preferable that the polyvinyl alcohol or the derivative thereof have a saponification rate of 70 to 99% by mole. When the saponification rate is less than 70% by mole, the effect of relaxing the stress in electrodeposits is degraded. In a case of complete saponification (saponification rate of 100% by mole), the solubility is significantly decreased and the polyvinyl alcohol or the derivative thereof may not be dissolved in a copper electrolyte. It is more preferable that the polyvinyl alcohol or the derivative thereof have a saponification rate of 70 to 90% by mole, but the saponification rate is not limited thereto. The saponification rate can be measured based on testing methods for polyvinyl alcohol defined in JIS K 6726:1994.

It is preferable that the polyvinyl alcohol or the derivative thereof of the stress relaxation agent have an average polymerization degree of 200 to 2500. The basic structure of the polyvinyl alcohol and the derivative thereof is formed of a completely saponified type with a hydroxyl group and a partially saponified type with an acetic acid group. The polymerization degree of the polyvinyl alcohol and the derivative thereof is the total value of those of completely saponified type and a partially saponified type, and the average polymerization degree is an average value of the polymerization degree. The average polymerization degree can be measured based on testing methods for polyvinyl alcohol defined in JIS K 6726:1994.

When an average polymerization degree of the polyvinyl alcohol or the derivative thereof is less than 200, the effect of relaxing the stress in electrodeposits is decreased. Further, since it is difficult to produce the polyvinyl alcohol or the derivative thereof having an average polymerization degree of less than 200 and these are not typically used, these are difficult to obtain. Moreover, when the average polymerization degree exceeds 2500, the effect of relaxing the stress in electrodeposits becomes poor and electrolytic copper deposited on the cathode substrate is easily warped. Further, when the average polymerization degree exceeds 2500, an electrodeposition suppression effect occurs so that the yield of electrolytic copper tends to be decreased. It is more preferable that the average polymerization degree of the polyvinyl alcohol or the derivative thereof be set to be in a range of 200 to 2000, but the degree is not limited thereto.

The concentration of the stress relaxation agent added to a copper electrolyte (concentration in a copper electrolyte) is preferably 0.1 to 100 mg/L and more preferably 1 to 50 mg/L. When the concentration of the stress relaxation agent is less than 0.1 mg/L, effect of preventing the warpage of electrolytic copper is not sufficient. When the concentration exceeds 100 mg/L, the effect of preventing the warpage of electrolytic copper cannot be seen and coarse dendrites generate.

In the present embodiment, the above-mentioned silver and chlorine reducing agent can be used with addition to any copper electrolyte including a copper sulfate aqueous solution, a copper nitrate aqueous solution, and a copper pyrophosphate aqueous solution. In cases where the impurity reducing agent, the stress relaxation agent, or both of them are used together with the silver and chlorine reducing agent of the present embodiment, any the above-mentioned solutions can be used as a copper electrolyte. The copper electrolysis can be performed under general conditions of copper electrolysis. Typically, the copper concentration of the copper electrolyte is preferably 5 to 90 g/L and more preferably 20 to 70 g/L, but the concentration is not limited thereto.

When the silver and chlorine reducing agent or the combination of the silver and chlorine reducing agent with the impurity reducing agent and/or the stress relaxation agent is used as the additive of the present embodiment, chloride ion concentration of a copper electrolyte other than a copper chloride bath is preferably 200 mg/L or less. When the chloride ion concentration exceeds 200 mg/L, since the effect of reducing chlorine of the silver and chlorine reducing agent lowers and a chloride is easily taken into the electrolytic copper, the purity of the electrolytic copper is degraded, which is not preferable. Further, it is preferable that the lower limit of the chloride ion concentration be set to 5 mg/L and more preferable that the chloride ion concentration be set to be in a range of 5 to 150 mg/L, but the concentration thereof is not limited thereto.

In a case where the additive of the present embodiment includes the silver and chlorine reducing agent and the impurity reducing agent, it is preferable that the silver and chlorine reducing agent and the impurity reducing agent be mixed with each other so that the concentration ratio thereof in copper electrolyte is 1:0.2 to 2000 (concentration of the silver and chlorine reducing agent: concentration of the impurity reducing agent) when the additive is added to the copper electrolyte. In a case where the additive of the present embodiment includes the impurity reducing agent and the stress relaxation agent, it is preferable that the impurity reducing agent and the stress relaxation agent be mixed with each other so that the concentration ratio thereof in copper electrolyte is 1:0.01 to 1 (concentration of the impurity reducing agent: concentration of the stress relaxation agent) when the additive is added to the copper electrolyte.

EXAMPLES

Examples and comparative examples of the present invention will be described below.

The sulfur concentration, chlorine concentration, and the silver concentration in each of electrolytic coppers produced in the examples and the comparative examples described below were measured by glow discharge mass spectrometry (GDMS) on the central portion of the electrolytic copper. As the glossiness of the surface of each of the electrolytic coppers, the glossiness of the central portion thereof was measured under the condition of an incident angle of 60° using a glossmeter (HANDY GLOSSMETER PG-1M, manufactured by NIPPON DENSHOKU INDUSTRIES Co., LTD.) in accordance with JIS Z 8741:1997 (corresponding to ISO 2813:1994 and ISO 7668:1986). When the glossiness thereof was low, since it was difficult to wash the copper electrolyte adhering to the surface of the electrolytic copper sufficiently with water, the copper electrolyte easily remained on the surface of the electrolytic copper and thus the purity of the electrolytic copper was degraded. The electrolytic copper on which coarse dendrites generated and the glossmeter could not be put and of which glossiness could not be measured, was evaluated as "x". The warpage of each of the electrolytic coppers was determined by visual observation. Electrolytic copper which was not warped was evaluated as "A", electrolytic copper which was slightly warped was evaluated as "B", and electrolytic copper which was greatly warped and apparently peeled from the cathode substrate was evaluated as "C". Specifically, electrolytic copper which did not peel from the cathode substrate was determined as not warped and evaluated as "A", electrolytic copper of which half or more of the area peeled from the cathode substrate was determined as greatly warped and evaluated as "C", and other electrolytic copper was determined as warped and was evaluated as "B". Electrolytic copper on which coarse dendrites were observed was evaluated as "presence", and electrolytic copper on which coarse dendrites were not observed was evaluated as "absence".

Example 1

The silver and chlorine reducing agents (A, B, C) configuring the additive of the present embodiment were used. The copper sulfate aqueous solution, the copper nitrate aqueous solution, or the copper pyrophosphate aqueous solution of which the acid concentration was set to 50 g/L, the copper concentration was set to 50 g/L, and the chloride ion concentration was set to 100 mg/L, was used as the copper electrolyte. The silver and chlorine reducing agent was added to the copper electrolyte so as to have the concentration listed in Table 1. Electrolytic copper having a sulfur concentration of 5 ppm by mass and a silver concentration of 8 ppm by mass was used as an anode and SUS 316 was used as a cathode substrate. The current density was set to 200 A/m$^2$ and copper electrolysis was performed at a bath temperature of 30° C. for five days. The concentration of the silver and chlorine reducing agent was measured by high-performance liquid chromatography (HPLC) using an ODS column every 12 hours and the decreased amount of the silver and chlorine reducing agent was replenished such that the concentration of the silver and chlorine reducing agent was maintained at the initial concentration, thereby electrodepositing electrolytic coppers on the SUS substrate. The used silver and chlorine reducing agents A, 13, and C are shown below. The results thereof are listed in Table 1.

Silver and chlorine reducing agent A: 1H-tetrazole

Silver and chlorine reducing agent B: 5-amino-1H-tetrazole

Silver and chlorine reducing agent C: 5-methyl-1H-tetrazole

As listed in Table 1, all of the electrolytic coppers produced using the silver and chlorine reducing agent configuring the additive of the present embodiments had small warpage, and it was possible to obtain high-purity electrolytic coppers with small amount of impurities such that the sulfur concentration was less than 10 ppm by mass, the silver concentration was less than 2 ppm by mass, and chlorine concentration was less than 80 ppm by mass. In particular, in the electrolytic coppers which were produced using the silver and chlorine reducing agent A while adjusting the concentration thereof at the range of 0.1 to 30 mg/L, the sulfur concentration was 7.3 ppm by mass or less, the silver concentration was 1 ppm by mass or less, and the chlorine concentration was 51 ppm by mass or less. Thus, it was possible to obtain the high grade-electrolytic coppers in which the concentrations of sulfur, silver and chlorine are significantly reduced, on the surface of which a coarse dendrite was not present, and which had the glossiness of 0.8 or more.

The electrolytic coppers which were produced using the silver and chlorine reducing agent B while adjusting the concentration thereof at 10 mg/L, were high-grade electrolytic coppers which had the sulfur concentration of 5.8 ppm by mass or less, the silver concentration of 0.52 ppm by mass or less, the chlorine concentration of 42 ppm by mass or less, and the glossiness of 0.9 or more, and on which a coarse dendrite was not presence, in any cases of using the sulfate bath or the nitrate bath. The electrolytic coppers which were produced using the silver and chlorine reducing agent C while adjusting the concentration thereof at 10 mg/L, were high-grade electrolytic coppers which had the sulfur concentration of 6.2 ppm by mass or less, the silver concentration of 0.68 ppm by mass or less, and the chlorine concentration of 46 ppm by mass or less, and on which a coarse dendrite was not presence, in any cases of using the sulfate bath or the pyrophosphate bath. The glossiness of the electrolytic copper was 0.5 in the case of using the pyrophosphate bath, while the electrolytic copper of which glossiness was as high as 0.7 could be obtained in the case of using the sulfate bath.

impurity reducing agents (F to K) and the stress relaxation agents (L to 0) are shown below. The results thereof are listed in Table 2.

Impurity reducing agent F: polyethylene glycol with average molecular weight of 1500

Impurity reducing agent G: polyethylene glycol with average molecular weight of 2500

Impurity reducing agent H: polyoxyethylene monophenyl ether with added number of moles of ethylene oxide of 5

Impurity reducing agent I: polyoxyethylene monophenyl ether with added number of moles of ethylene oxide of 10

Impurity reducing agent J: polyoxyethylene naphthyl ether with added number of moles of ethylene oxide of 7

Impurity reducing agent K: polyoxyethylene naphthyl ether with added number of moles of ethylene oxide of 15

Stress relaxation agent L: polyvinyl alcohol with saponification rate of 88% by mole and average polymerization degree of 300

Stress relaxation agent M: polyvinyl alcohol with saponification rate of 88% by mole and average polymerization degree of 600

Stress relaxation agent N: carboxy-modified polyvinyl alcohol with saponification rate of 98% by mole and average polymerization degree of 600

Stress relaxation agent O: polyoxyethylene-modified polyvinyl alcohol with saponification rate of 98% by mole and average polymerization degree of 700

TABLE 1

| | Silver and chlorine reducing agent | | Acid type | Electrolytic copper | | | | | |
|---|---|---|---|---|---|---|---|---|---|
| No | Type | Concentration (mg/L) | of copper electrolyte | Warpage | S (ppm) | Ag (ppm) | Cl (ppm) | Glossiness | Dendrites |
| 1 | A | 0.05 | Sulfuric | B | 5.1 | 1.14 | 79 | 0.8 | Absence |
| 2 | | 0.1 | acid | B | 5.4 | 0.72 | 49 | 0.8 | Absence |
| 3 | | 0.5 | | B | 4.8 | 0.54 | 45 | 1 | Absence |
| 4 | | 1 | | B | 5.9 | 0.48 | 36 | 1.1 | Absence |
| 5 | | 10 | | B | 6.1 | 0.41 | 38 | 1.2 | Absence |
| 6 | | 30 | | B | 7.3 | 0.69 | 51 | 1.1 | Absence |
| 7 | | 50 | | B | 9.8 | 1.92 | 69 | x | Presence |
| 8 | B | 10 | Sulfuric acid | B | 5.8 | 0.48 | 42 | 1.1 | Absence |
| 9 | | | Nitric acid | B | 1.4 | 0.52 | 37 | 0.9 | Absence |
| 10 | C | 10 | Sulfuric acid | B | 6.2 | 0.55 | 35 | 0.7 | Absence |
| 11 | | | Pyrophosphoric acid | B | 4.2 | 0.68 | 46 | 0.5 | Absence |

(Note)
S represents the sulfur concentration, Ag represents the silver concentration, Cl represents the chlorine concentration, and ppm represents ppm by mass.

Example 2

As listed in Table 2, the impurity reducing agents (F, G, H, I, J, K) or the combination of the impurity reducing agents and the stress relaxation agents (L, M, N, O) were used with addition to the copper electrolyte together with the silver and chlorine reducing agents A, B, C of the Example 1 or the other silver and chlorine reducing agent D (5-phenyl-1H-tetrazole). The concentration of each of the silver and chlorine reducing agents in the copper electrolyte was set to 10 mg/L. The concentration of each of the impurity reducing agents in the copper electrolyte was set to 10 or 100 mg/L. When the stress relaxation agent was used, the concentration thereof was 10 mg/L. Under the same conditions as the Example 1 including the acid, copper, and chloride ion concentrations in the copper electrolyte and the other electrolytic conditions, the copper electrolytic refining was performed to produce electrolytic copper. The used As listed in Table 2, the electrolytic coppers produced using the silver and chlorine reducing agents and the impurity reducing agents configuring the additive of the present embodiments were high-purity electrolytic coppers with the sulfur concentration of 1.21 ppm by mass or less, the silver concentration of 0.5 ppm by mass or less, and the chlorine concentration of 30 ppm by mass or less, and were also high-grade electrolytic coppers with the glossiness of 2 or more and small warpage. In the cases of using the stress relaxation agent together with them, high-grade electrolytic coppers which were not warped could be obtained.

In each of the electrolytic coppers listed in Table 2, by using the impurity reducing agent together with the silver and chlorine reducing agent configuring the additive of the present embodiment, the sulfur concentration, the silver concentration, and the chlorine concentration in the electrolytic copper were significantly reduced and the electrolytic copper with high glossiness could be obtained.

TABLE 2

| No | Silver and chlorine reducing agent | Impurity reducing agent Type | Concentration (mg/L) | Stress relaxation agent | Acid type of copper electrolyte | Electrolytic copper Warpage | S (ppm) | Ag (ppm) | Cl (ppm) | Glossiness |
|---|---|---|---|---|---|---|---|---|---|---|
| 20 | A | F | 10 | — | Sulfuric acid | B | 1.21 | 0.09 | 25 | 2.5 |
| 21 | | | 100 | L | | A | 0.82 | 0.05 | 28 | 2.4 |
| 22 | | | | — | | B | 0.21 | 0.15 | 26 | 2.5 |
| 23 | | | | L | | A | 0.02 | 0.02 | 21 | 2.8 |
| 24 | | | | M | | A | 0.01 | 0.04 | 24 | 2.6 |
| 25 | | | | N | | A | 0.03 | 0.03 | 27 | 2.5 |
| 26 | | | | O | | B | 0.05 | 0.09 | 25 | 3.0 |
| 27 | | G | 100 | — | | B | 0.19 | 0.11 | 28 | 2.8 |
| 28 | | | | L | | A | 0.07 | 0.07 | 21 | 2.8 |
| 29 | | H | 100 | — | | B | 0.15 | 0.09 | 29 | 2.6 |
| 30 | | | | M | | A | 0.01 | 0.02 | 16 | 3.1 |
| 31 | | I | 100 | — | | B | 0.12 | 0.10 | 30 | 2.4 |
| 32 | | | | N | | A | 0.04 | 0.02 | 22 | 2.6 |
| 33 | | J | 100 | — | | B | 0.11 | 0.13 | 28 | 2.5 |
| 34 | | | | O | | A | 0.01 | 0.05 | 25 | 2.9 |
| 35 | | K | 10 | L | | A | 0.09 | 0.08 | 29 | 2.9 |
| 36 | | | 100 | L | | A | 0.05 | 0.06 | 27 | 3.0 |
| 37 | B | F | 100 | — | Sulfuric acid | B | 0.14 | 0.14 | 26 | 2.5 |
| 38 | | | | L | | A | 0.02 | 0.06 | 25 | 3.1 |
| 39 | | H | 10 | — | | B | 0.74 | 0.21 | 26 | 2.2 |
| 40 | | | | L | | A | 0.38 | 0.06 | 21 | 2.2 |
| 41 | | | 100 | — | | B | 0.17 | 0.16 | 22 | 2.3 |
| 42 | | | | M | | A | 0.04 | 0.06 | 19 | 2.6 |
| 43 | C | F | 10 | — | Nitric acid | B | 0.04 | 0.21 | 25 | 2.3 |
| 44 | | | | N | Pyrophosphoric acid | A | 0.08 | 0.49 | 22 | 2.2 |
| 45 | | | 100 | — | | B | 0.11 | 0.21 | 27 | 2.5 |
| 46 | | | | L | | A | 0.05 | 0.19 | 24 | 2.8 |
| 47 | | J | 100 | — | Sulfuric acid | B | 0.15 | 0.08 | 26 | 2.3 |
| 48 | | | | N | | A | 0.03 | 0.01 | 21 | 2.7 |
| 49 | D | F | 100 | — | Nitric acid | B | 0.08 | 0.21 | 28 | 2.9 |
| 50 | | | | O | | A | 0.01 | 0.17 | 26 | 3.1 |
| 51 | | J | 10 | — | Nitric acid | B | 0.08 | 0.32 | 21 | 2.4 |
| 52 | | | | O | Sulfuric acid | A | 0.46 | 0.10 | 14 | 2.3 |

(Note)
S represents the sulfur concentration, Ag represents the silver concentration, Cl represents the chlorine concentration, and ppm represents ppm by mass. The concentration of the stress relaxation agent was 10 mg/L and "—" represents no addition thereof.

Comparative Example 1

As comparative example, the copper electrolytic refining was performed to produce the electrolytic copper under the same conditions as Example 1 except that the impurity reducing agent F or the combination of the impurity reducing agent F and the stress relaxation agent M was used without using the silver and chlorine reducing agent configuring the additive of the present embodiment. Each of the concentrations of the impurity reducing agent F and the stress relaxation agent M in the copper electrolyte was set to 10 mg/L. The results thereof are listed in Table 3. As listed in Table 3, in each of the samples (Nos. 30 to 32) of this comparative example, the chlorine concentration in the electrolytic copper was significantly high and about 2 to 6 times of those in the Example 1. The silver concentrations were about 1.1 to 5 times of those in the Example

TABLE 3

| No | Silver and chlorine reducing agent | Impurity reducing agent | Stress relaxation agent | Acid type of copper electrolyte | Electrolytic copper Warpage | S (ppm) | Ag (ppm) | Cl (ppm) | Glossiness |
|---|---|---|---|---|---|---|---|---|---|
| 30 | — | — | — | Nitric acid | B | 2 | 2.1 | 105 | 0.5 |
| 31 | | F | — | Pyrophosphoric acid | C | 1.2 | 1.6 | 205 | 2.5 |
| 32 | | F | M | Sulfuric acid | A | 0.7 | 1.1 | 64 | 1.9 |

(Note)
Each of the concentrations of the impurity reducing agent and the stress relaxation agent was 10 mg/L and "—" represents no addition thereof.

While preferred embodiments of the invention have been described above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

INDUSTRIAL APPLICABILITY

According to the additive for high-purity copper electrolytic refining and the method of producing high-purity copper of the present invention, high-purity copper in which concentrations of chlorine and silver are small can be easily produced.

What is claimed is:

1. An additive for high-purity copper electrolytic refining which is an additive to be added to a copper electrolyte in copper electrolytic refining, the additive comprising:

a silver and chlorine reducing agent of electrolytic copper which is formed of one of tetrazoles selected from a tetrazole and a tetrazole derivative, wherein the additive further comprises a stress relaxation agent formed of a polyvinyl alcohol or a derivative thereof, the polyvinyl alcohol or the derivative thereof in the stress relaxation agent has a saponification rate of 70 to 99% by mole and an average polymerization degree of 200 to 2500, and the tetrazole derivative is one of an alkyl derivative, an amino derivative, and a phenyl derivative of tetrazole.

2. The additive for high-purity copper electrolytic refining according to claim 1, wherein the additive further comprises an impurity reducing agent formed of one of a polyethylene glycol and a non-ionic surfactant, the non-ionic surfactant having a hydrophobic group containing an aromatic ring and a hydrophilic group containing a polyoxyalkylene group.

3. The additive for high-purity copper electrolytic refining according to claim 1, wherein the additive further comprises an impurity reducing agent formed of one of a polyethylene glycol and a non-ionic surfactant, the non-ionic surfactant having a hydrophobic group containing an aromatic ring and a hydrophilic group containing a polyoxyalkylene group.

4. A method of producing high-purity copper, comprising:

performing copper electrolytic refining using a copper electrolyte to which a silver and chlorine reducing agent formed of one of tetrazoles is added, wherein a concentration of the silver and chlorine reducing agent in the copper electrolyte is set to be in a range of 0.1 to 30 mg/L, and the one of tetrazoles is selected from a tetrazole and a tetrazole derivative, and the tetrazole derivative is one of an alkyl derivative, an amino derivative, and a phenyl derivative of tetrazole.

5. The method of producing high-purity copper according to claim 4, wherein the copper electrolytic refining is performed using the copper electrolyte to which a impurity reducing agent formed of one of a polyethylene glycol and a non-ionic surfactant is added together with the silver and chlorine reducing agent, the non-ionic surfactant having a hydrophobic group containing an aromatic ring and a hydrophilic group containing a polyoxyalkylene group.

6. The method of producing high-purity copper according to claim 5, wherein the impurity reducing agent is one of a polyethylene glycol, a polyoxyethylene monophenyl ether, and a polyoxyethylene naphthyl ether.

7. The method of producing high-purity copper according to claim 6, wherein the copper electrolytic refining is performed using the copper electrolyte to which a stress relaxation agent is added together with the silver and chlorine reducing agent or combination of the silver and chlorine reducing agent and the impurity reducing agent, the stress relaxation agent being formed of a polyvinyl alcohol or a derivative thereof.

8. The method of producing high-purity copper according to claim 5, wherein a concentration of the impurity reducing agent in the copper electrolyte is set to be in a range of 2 to 500 mg/L.

9. The method of producing high-purity copper according to claim 5, wherein the copper electrolytic refining is performed using the copper electrolyte to which a stress relaxation agent is added together with the silver and chlorine reducing agent or combination of the silver and chlorine reducing agent and the impurity reducing agent, the stress relaxation agent being formed of a polyvinyl alcohol or a derivative thereof.

10. The method of producing high-purity copper according to claim 4, wherein the copper electrolytic refining is performed using the copper electrolyte to which a stress relaxation agent is added together with the silver and chlorine reducing agent or combination of the silver and chlorine reducing agent and the impurity reducing agent, the stress relaxation agent being formed of a polyvinyl alcohol or a derivative thereof.

11. The method of producing high-purity copper according to claim 10, wherein the stress relaxation agent is one of a polyvinyl alcohol, a carboxy-modified polyvinyl alcohol, an ethylene-modified polyvinyl alcohol, and a polyoxyethylene-modified polyvinyl alcohol.

12. The method of producing high-purity copper according to claim 10, wherein the polyvinyl alcohol or the derivative thereof which has a saponification rate of 70 to 99% by mole and an average polymerization degree of 200 to 2500 is used as the stress relaxation agent.

13. The method of producing high-purity copper according to claim 10, wherein a concentration of the stress relaxation agent in the copper electrolyte is set to be in a range of 0.1 to 100 mg/L.

* * * * *